US005735686A

United States Patent [19]

Hildreth, Jr.

[11] Patent Number: 5,735,686

[45] Date of Patent: Apr. 7, 1998

[54] COMBUSTION BLOWER SHAFT LEAKAGE RELIEF

[75] Inventor: Edward D. Hildreth, Jr., Clarksville, Tenn.

[73] Assignee: American Standard Inc., Piscataway, N.J.

[21] Appl. No.: 712,100

[22] Filed: Sep. 11, 1996

[51] Int. Cl.[6] ..... F23D 14/62

[52] U.S. Cl. ..... 431/354; 431/328; 415/58.2; 415/170.1; 416/187

[58] Field of Search ..... 431/354; 416/182, 416/187, 178; 415/58.2, 170.1, 171.1

[56] References Cited

U.S. PATENT DOCUMENTS

| | | | |
|---|---|---|---|
| 985,152 | 2/1911 | Fieroe | 416/178 |
| 1,431,633 | 10/1922 | Clements | 431/354 |
| 2,104,233 | 1/1938 | Leinweber | 416/178 |
| 2,302,095 | 11/1942 | Bartch | 416/178 |
| 2,362,868 | 11/1944 | Upson | 416/178 |
| 3,536,416 | 10/1970 | Glucksman | 416/178 |
| 4,494,908 | 1/1985 | Hopfensperger | 415/206 |
| 4,830,600 | 5/1989 | VerShaw et al. | 431/8 |
| 4,838,762 | 6/1989 | Savage et al. | 416/178 |
| 5,060,720 | 10/1991 | Wollaber et al. | 165/122 |
| 5,171,128 | 12/1992 | Williamson et al. | 416/223 |
| 5,393,224 | 2/1995 | Allen et al. | 431/266 |
| 5,460,157 | 10/1995 | Prabhu | 431/354 |

*Primary Examiner*—Carroll Dority
*Attorney, Agent, or Firm*—William J. Beres; William O'Driscoll; Peter D. Ferguson

[57] ABSTRACT

A method of operating a pre-mix power burner assembly. The method comprises the steps of: using a fan to supply and control combustion; mixing fuel gas and primary air together; introducing the mixture into secondary air in a combustion zone; and relieving pressure on the exterior of the fan near the fan shaft to the interior of the fan.

7 Claims, 1 Drawing Sheet

COMBUSTION BLOWER SHAFT LEAKAGE RELIEF

BACKGROUND OF THE INVENTION

The present invention is directed to pre-mixed power burner systems such as those used in commercial and residential furnaces. More specifically, the present invention is intended to eliminate the leakage of combustible materials and to avoid the subsequent disputed service calls from detection of gas odors.

Power burners use a fan to control and supply combustion. In a pre-mixed power burner, gas and primary air are mixed together and the mixture is then introduced into secondary air in the combustion zone. Premixed power burners are commonly used in rooftop HVAC units such as shown in commonly assigned U.S. Pat. No. 5,393,224 to Allen et al. and 4,830,600 to VerShaw et al., the disclosures of which are hereby incorporated by reference.

Such pre-mixed power burner systems including a motor and a fan wheel on a common shaft but separated by the combustion blower housing. A shaft seal around the shafts penetration of the combustion housing is required else the higher pressure outside the fan wheel urges the mixture of combustion gas around the shaft into the vicinity of the motor. Without the shaft seal, or if the shaft seal is not effective, the combustion gas in the vicinity of the motor is detected by electronic gas detectors or by the user smelling the gas odorant. This detection leads to disputed service calls concerning the integrity of the burner system where no problem actually exists with the performance of the heating device.

SUMMARY OF THE INVENTION

It is an object, feature and advantage of the present invention to solve the problems with prior pre-mixed power burner systems.

It is an object, feature and advantage of the present invention to eliminate the shaft seal in pre-mixed power burner systems where the combustion motor shaft penetrates the combustion blower housing.

It is an object, feature and advantage of the present invention to lower the bill of materials parts count for a pre-mixed power burner system.

It is an object, feature and advantage of the present invention to eliminate the combustible mixture leakage where the combustion motor shaft penetrates the combustion blower housing.

It is an object, feature and advantage of the present invention to lower the service costs associated with a pre-mixed power burner system due to gas indications from highly sensitive gas detectors.

It is an object, feature and advantage of the present invention to greatly reduce disputed service calls concerning the detection of gas owners in a pre-mixed power burner system.

it is an object, feature and advantage of the present invention to accomplish these purposes without adding new components.

The present invention provides a combustion blower. The combustion blower comprises a shaft and an impeller attached to and rotating about the shaft. The impeller includes a first end plate including an aperture providing an entrance for fuel and air and a second end plate attached to the shaft and supporting impeller blades. The impeller blades are attached between the first and second end plates and the second end plate includes pressure reducing apertures in the end plate located proximal the shaft.

The present invention also provides a pre-mixed power burner assembly. The power burner assembly comprises a motor, a shaft operably connected to and motivated by the motor, a combustion wheel rotatably mounted on the shaft and including first and second end plates operably connected to and surrounding the shaft and a housing including a combustion blower housing about the blower. The first and second end plates are operably connected to each other by a plurality of impeller blades arranged such that the impeller blades and the first and second end plates form a low pressure interior within the combustion wheel. The combustion blower housing separates the combustion blower from the motor, and the combustion blower housing includes an aperture in the combustion blower housing to allow passage of the shaft. The first end plate is proximal the combustion blower housing and includes at least one pressure reducing aperture(s) located in the general vicinity of the shaft. The pressure reducing aperture(s) allows high pressure fluid around the combustion wheel to enter the low pressure interior.

The present invention further provides a method of operating a pre-mix power burner assembly. The method comprises the steps of: using a fan to supply and control combustion; mixing fuel gas and primary air together; introducing the mixture into secondary air in a combustion zone; and relieving pressure on the exterior of the fan near the fan shaft to the interior of the fan. The method includes the further step of arranging the apertures equidistant around the fan shaft. Alternatively, the apertures are of an irregular shape and spacing but arranged to provide a consistent volume of flow about the fan shaft.

Finally, the present invention provides an impeller for a centrifugal fan. The impeller comprises: a shaft; a first end plate operably connected to and rotatable with the shaft, a plurality of impeller blades having a first end affixed to the first end plate such that the blades are rotatable with the first end plate, and a second end plate affixed to the second ends of the impeller blades and rotatable therewith. The end plate includes pressure reducing apertures located about the shaft. The blades are arranged generally parallel with the shaft, the impeller blades including a second end. The second end includes a fluid inlet aperture providing an inlet for fluid to be compressed.

DETAILED DESCRIPTION OF THE DRAWINGS

Pre-mixed power burner systems are well known in the art and are components of rooftop air conditioning systems sold by The Trane Company, a Division of American Standard Inc., under the trademark Voyager™. For purposes of the present invention, any conventional pre-mixed power burner system or modification thereof is pertinent and the invention can be applied to such a system. The relevant details of the pre-mixed power burner system are discussed as follows with reference to FIGS. 1 and 2.

Figure 1:
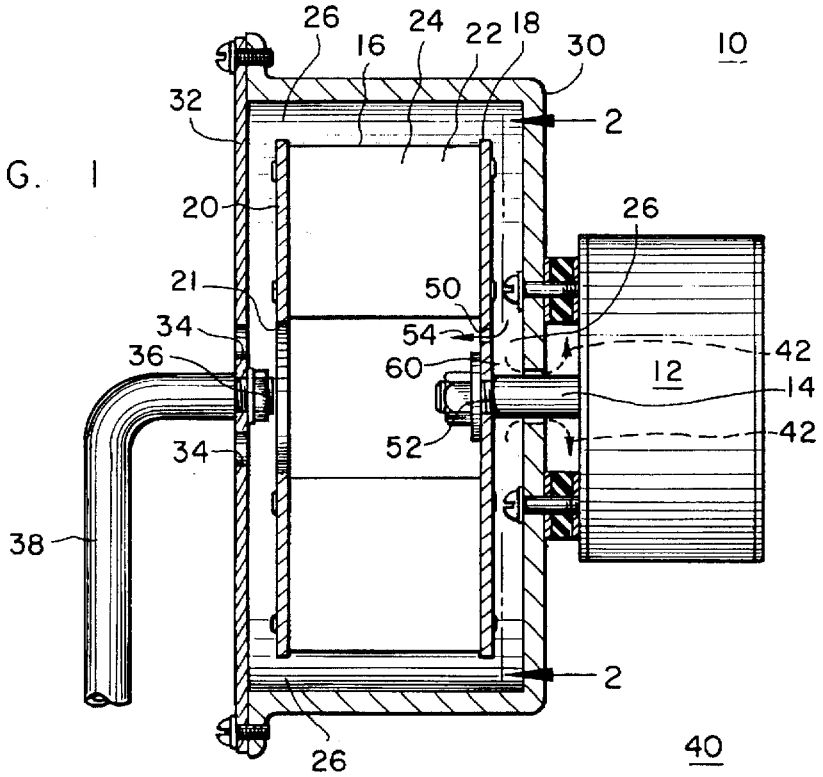
FIG. 1 shows a plan view of a combustion wheel, partial housing and motor.
Figure 2:
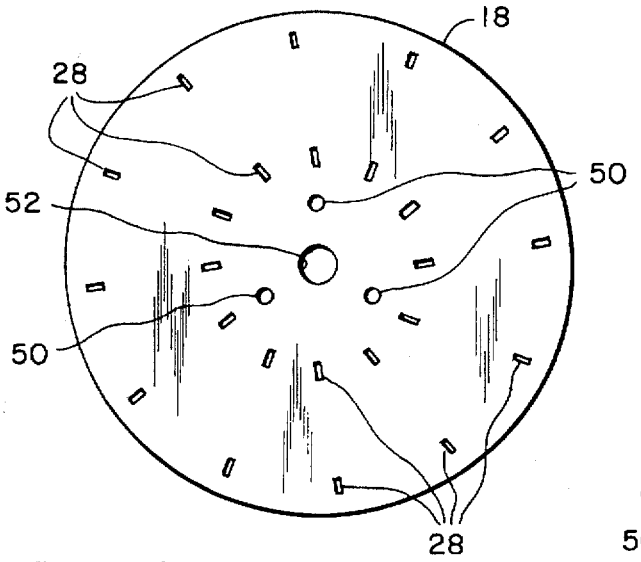
FIG. 2 shows an end plate for the combustion wheel of FIG. 1 along lines 2—2 of FIG. 1.

FIG. 1 shows a portion of the components of a pre-mixed power burner system 10 including a motor 12 and a shaft 14 operably connected to and driven by the motor 12. A combustion wheel or impeller 16 is rotatably mounted on the shaft 14 by a first combustion wheel end plate 18. The combustion wheel 16 includes a second combustion wheel end plate 20 parallel to the first combustion wheel end plate 18. The second end plate 20 includes an aperture 21 allowing fluids such as gas, primary air and secondary air to enter the combustion wheel 16. The end plates 18, 20 are connected by impeller blades 22 so that the combustion wheel 16, when rotating, forms a low pressure space 24 in the area surrounded by the end plates 18, 20 and the impeller blades 22. The low pressure space 24 results from the action of the combustion wheel 16 propelling a fluid outwardly and creating a higher pressure space 26 around the combustion wheel 16. The end plates 18 include conventional impeller blade crimped tab attachment fasteners 28. Effectively, the first end plate 18 is rotatably supported by the shaft 14. In turn, the plate rotatably supports a first end of the impeller blades 22. The other end of the impeller blades 22 rotatably supports the second end plate 20.

The motor 12 and the combustion wheel 16 are separated from each other by a combustion blower housing 30. The housing 30 is penetrated by the shaft 14. The first end plate 18 is adjacent or proximal the combustion blower housing 30 while the second end plate 20 is adjacent another housing portion 32 which includes an aperture 34 to pass primary and secondary air, and an aperture 36 to pass fuel gas from a gas pipe 38.

Since the area 40 around the motor 12 is not pressurized, the higher pressure area 26 has a leakage path around the shaft 14 through the blower housing 30 as shown by dashed arrows 42. This leakage of combustion gas 42 into the area 40 is smelled by the owner or user of the pre-mixed power burner system or is detected by sensitive electronic gas detectors resulting, in either case, in service calls questioning the operability of the pre-mixed power burner system.

The present invention addresses and solves this problem by adding pressure reducing apertures 50 in the first end plate 18. These apertures 50 are located in the first end plate 18 about an aperture 52 which provides a passage for the shaft 14. As shown by the arrows 54 in FIG. 1, the pressure reducing apertures 50 provide a pressure relief path from the high pressure area 26 back to the low pressure area 24. Preferably, these pressure reducing apertures 50 are located in the vicinity of the shaft 14 so as to create a reduced pressure area 60 near the shaft 14, thereby reducing the pressure imbalance between the area 26 and the area 40. By bleeding off pressure from the area 26 before that pressure reaches the shaft 14, the use of these apertures 50 avoids the necessity of a shaft seal around the shaft 14 where the shaft 14 penetrates the combustion blower housing 30. Without the high pressure from the area 26, combustion gases are not forced around the shaft 14 through the blower housing 30.

Figure 3:
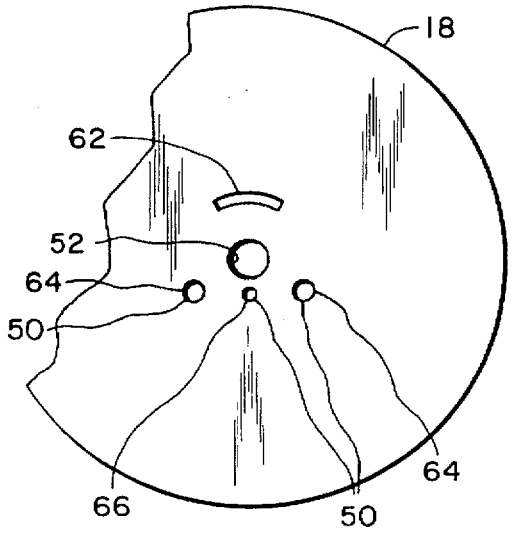
FIG. 3 shows an alternative end plate for the combustion wheel of FIG. 1 also taken along lines 2—2 of FIG. 1.

The present invention has been set forth as a clever and inexpensive solution to the problem of false gas leakage alarms while eliminating the necessity of a shaft seal around the motor shaft's penetration of the combustion blower housing. Obviously, there are many other modifications and alterations dependent upon the type and geometry of a particular fan. One such alternative embodiment is shown in FIG. 3 where the pressure reducing apertures 50 are irregularly spaced and of different sizes. A single large aperture 62 is shown as well as a pair of circular apertures 64 located on the opposite side of the shaft 52 from the single large aperture 62. A small aperture 66 is provided between the aperture 64 but closer to the shaft 52 than the aperture 64. Although the apertures 62, 66, 64 are of different sizes and spacing, the volume of air flowing about the shaft is consistent, and resultant pressure reduction is generally balanced. Thus FIG. 3 shows a modification of the preferred embodiment. All such modifications and alterations are contemplated to fall within the scope and spirit of the invention as claimed by the attached claims.

What is desired and claimed as Letters Patent of the United States is set forth as follows:

1. A combustion blower comprising:

a shaft;

an impeller attached to and rotating about the shaft, the impeller including a first end plate including a central aperture providing an entrance for fuel and air and a second end plate attached to the shaft and supporting impeller blades, the impeller blades being attached between the first and second end plates; said shaft being attached to a central region of said second plate the second end plate includes pressure reducing apertures located proximal the shaft;

a housing arranged about the shaft and the impeller, means for supplying fuel into said housing adjacent the aperture in the first end plate; and said housing having an opening slightly larger in diameter than said shaft to allow said shaft to extend out of said housing.

2. The combustion blower of claim 1 wherein the pressure reducing apertures are located equidistance from each other about the shaft.

3. The combustion blower of claim 1 wherein the pressure reducing apertures are irregularly spaced around the shaft.

4. The combustion blower of claim 3 wherein there are a plurality of pressure reducing apertures have different shapes.

5. A pre-mixed power burner assembly comprising:

motor;

shaft operably connected to and motivated by the motor;

a combustion wheel rotatably mounted on the shaft and including first and second end plates operably connected to and surrounding the shaft, the first and second end plates being operably connected to each other by a plurality of impeller blades arranged such that the impeller blades and the first and second end plates form a low pressure interior within the combustion wheel; and a housing about the combustion wheel, the combustion wheel housing separating the combustion wheel from the motor, the combustion wheel housing including an aperture slightly larger than said shaft to allow passage of the shaft; said shaft being connected to a central region of said first end plate; and wherein the first end plate is proximal the combustion wheel housing and includes at least one pressure reducing aperture(s) located in the general vicinity of the shaft, the pressure reducing aperture(s) allowing high pressure fluid around the combustion wheel to enter the low pressure interior.

6. The pre-mix power burning assembly of claim 5 including three pressure reducing apertures in the end plate located generally equidistant from each other and proximal the shaft.

7. The pre-mix power burner assembly of claim 5 wherein the at least one pressure reducing aperture includes a plurality of apertures of different sizes spaced around the shaft.

* * * * *